US010990054B2

(12) United States Patent
Mori

(10) Patent No.: US 10,990,054 B2
(45) Date of Patent: Apr. 27, 2021

(54) IMAGE FORMING APPARATUS THAT CORRECTS A TARGET TEMPERATURE FOR HEATING A REGION WITHOUT A TONER IMAGE WHEN AN ABNORMALITY IS DETECTED

(71) Applicant: CANON KABUSHIKI KAISHA, Tokyo (JP)

(72) Inventor: Atsunobu Mori, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/863,122

(22) Filed: Apr. 30, 2020

(65) Prior Publication Data

US 2020/0264547 A1 Aug. 20, 2020

Related U.S. Application Data

(63) Continuation of application No. 16/239,135, filed on Jan. 3, 2019, now Pat. No. 10,678,177.

(30) Foreign Application Priority Data

Jan. 5, 2018 (JP) ..... JP2018-000837

(51) Int. Cl.
*G03G 15/20* (2006.01)
*G03G 15/00* (2006.01)

(52) U.S. Cl.
CPC ..... *G03G 15/55* (2013.01); *G03G 15/205* (2013.01); *G03G 15/2042* (2013.01); *G03G 15/5012* (2013.01)

(58) Field of Classification Search
CPC .. G03G 15/55; G03G 15/553; G03G 15/2042; G03G 15/205; G03G 15/5012
USPC ..... 399/18, 19, 31, 33, 334; 219/216
See application file for complete search history.

(56) References Cited

U.S. PATENT DOCUMENTS

| | | | |
|---|---|---|---|
| 9,069,302 | B2 | 6/2015 | Samei et al. |
| 9,122,212 | B2 | 9/2015 | Fujimoto et al. |
| 2006/0269304 | A1 | 11/2006 | Peng et al. |
| 2007/0189786 | A1 | 8/2007 | Aoki et al. |
| 2013/0209115 | A1 | 8/2013 | Hase et al. |
| 2014/0270831 | A1 | 9/2014 | Yoshinaga et al. |
| 2015/0098715 | A1 | 4/2015 | Sakurai |

FOREIGN PATENT DOCUMENTS

| | | | |
|---|---|---|---|
| JP | H06-95540 | A | 4/1994 |
| JP | 2007-271870 | A | 10/2007 |
| JP | 2014-170217 | A | 9/2014 |

(Continued)

*Primary Examiner* — Robert B Beatty
(74) *Attorney, Agent, or Firm* — Venable LLP

(57) ABSTRACT

An energization controlling portion selectively controls energization of a plurality of heat generating elements so that electric power to be supplied to the heat generating elements to heat a non-image heating region, through which an image formed on a recording material does not pass, among a plurality of heating regions of an image heating portion, is smaller than electric power to be supplied to the heat generating elements to heat an image heating region, through which the image passes, among the plurality of heating regions. When an abnormality detecting portion detects an abnormality in an image forming apparatus, the energization controlling portion increases the electric power to be supplied to the heat generating elements to heat the non-image heating region.

10 Claims, 13 Drawing Sheets

(56) References Cited

FOREIGN PATENT DOCUMENTS

| | | | |
|---|---|---|---|
| JP | 2015-028506 | A | 2/2015 |
| JP | 2015-036770 | A | 2/2015 |
| JP | 2015-036784 | A | 2/2015 |

IMAGE FORMING APPARATUS THAT CORRECTS A TARGET TEMPERATURE FOR HEATING A REGION WITHOUT A TONER IMAGE WHEN AN ABNORMALITY IS DETECTED

CROSS-REFERENCE TO RELATED APPLICATIONS

This application is a Continuation of U.S. patent application Ser. No. 16/239,135, filed on Jan. 3, 2019, which claims priority to Japanese Patent Application No. 2018-000837, filed Jan. 5, 2018. Each of the forgoing applications is hereby incorporated by reference herein in its entirety.

BACKGROUND OF THE INVENTION

Field of the Invention

The present invention relates to an image heating apparatus such as a fixing unit that is mounted on an image forming apparatus utilizing an electrophotographic system or an electrostatic recording system, such as a copying machine or a printer, or a gloss-imparting device for reheating a toner image fixed on a recording material, thereby increasing the gloss level of the toner image. The present invention also relates to an image forming apparatus including the image heating apparatus.

Description of the Related Art

As an image heating apparatus, there is an apparatus including an endless belt (also called an endless film), a heater in contact with the inner surface of the endless belt, a roller forming a nip portion together with the heater through the endless belt. This image heating apparatus has a feature of having a small heat capacity and thus being excellent in quick start property and power efficiency. In recent years, however, higher power efficiency has been demanded more than ever, and to meet the demand, there has been proposed a method for selectively heating an image portion formed on a recording material (Embodiment 11 of Japanese Patent Application Laid-open No. H06-95540). In this method, a plurality of heating regions, which are obtained through division, are set in a direction orthogonal to the conveyance direction of a recording material (hereinafter referred to as "longitudinal direction"), and a plurality of heat generating elements for heating the respective heating regions are provided in the longitudinal direction. On the basis of image information on an image to be formed in each heating region, the image portion is selectively heated by the corresponding heat generating element. Further, there has also been proposed a method for adjusting heating conditions depending on image information, thereby achieving high power efficiency (Japanese Patent Application Laid-open No. 2007-271870).

SUMMARY OF THE INVENTION

When optimal heating control is performed on an image in each heating region with the use of the method described in Japanese Patent Application Laid-open No. H06-95540 or Japanese Patent Application Laid-open No. 2007-271870, a high power efficiency effect can be obtained. In an image forming apparatus, however, toner adheres to a non-image region on a sheet in some cases due to the malfunction of the apparatus, the deterioration of consumable items, or other factors. When toner adheres to a non-image region in the image heating apparatus in which the non-image region is not heated or is heated at a low heating temperature as described above, the toner adhering to the non-image region remains on a sheet without being melted even after fixing treatment. The toner that has not been completely melted and remained on the sheet soils inside and outside the apparatus.

It is an object of the present invention to provide an image forming apparatus capable of performing heating control that prevents the generation of toner that is not sufficiently fixed to a recording material.

In order to achieve the above-mentioned object, according to the present invention, there is provided an image forming apparatus including: an image heating portion that includes a heater including a substrate and a plurality of heat generating elements provided on the substrate and aligned in a longitudinal direction of the substrate, and heats an image formed on a recording material using heat of the heater; an energization controlling portion for controlling electric power to be supplied to the plurality of heat generating elements, the energization controlling portion selectively controlling the electric power to be supplied to the plurality of heat generating elements so that electric power to be supplied to the heat generating elements to heat a non-image heating region, through which the image does not pass, among a plurality of heating regions that are heated by the plurality of heat generating elements, is smaller than electric power to be supplied to the heat generating elements to heat an image heating region, through which the image passes, among the plurality of heating regions; and an abnormality detecting portion for detecting an abnormality in the image forming apparatus, wherein when the abnormality detecting portion detects the abnormality, the energization controlling portion increases the electric power to be supplied to the heat generating elements to heat the non-image heating region.

In order to achieve the above-mentioned object, according to the present invention, there is provided an image forming apparatus, including: an image heating portion that includes a heater including a substrate and a plurality of heat generating elements provided on the substrate and aligned in a longitudinal direction of the substrate, and heats an image formed on a recording material using heat of the heater; an energization controlling portion for controlling electric power to be supplied to the plurality of heat generating elements, the energization controlling portion selectively controlling energization of the plurality of heat generating elements so that electric power to be supplied to the heat generating elements to heat a non-image heating region, through which the image does not pass, among a plurality of heating regions that are heated by the plurality of heat generating elements, is smaller than electric power to be supplied to the heat generating elements to heat an image heating region, through which the image passes, among the plurality of heating regions; and a consumption detecting portion for detecting a consumption degree of a consumable item provided in the image forming apparatus, wherein when the consumption degree detected by the consumption detecting portion exceeds a predetermined consumption degree, the energization controlling portion increases the electric power to be supplied to the heat generating elements to heat the non-image heating region.

According to the present invention, it is possible to perform the heating control that prevents the generation of toner that is not sufficiently fixed to a recording material.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Configuration of Image Forming Apparatus

Figure 2:
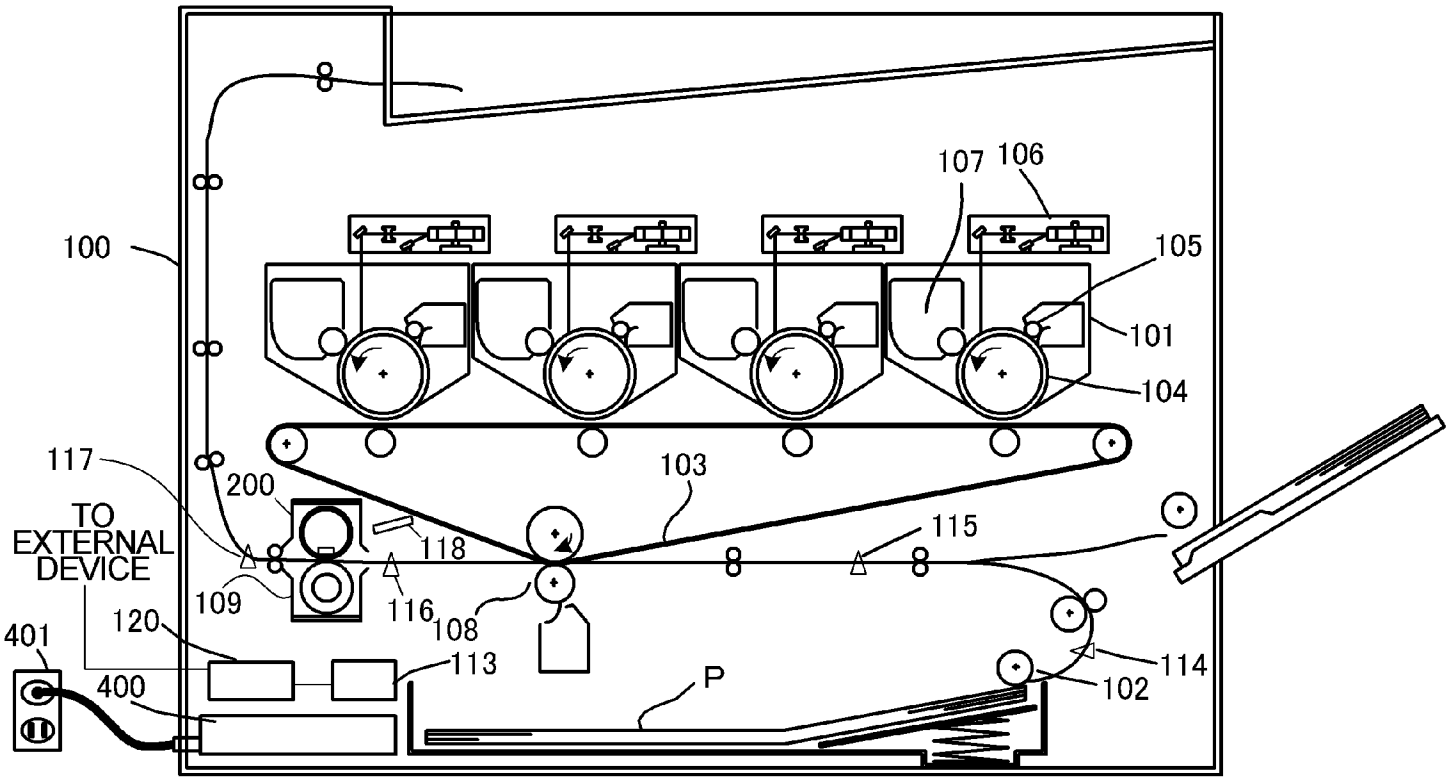
FIG. 2 is a schematic sectional view of an image forming apparatus 100.

FIG. 2 is an exemplary configuration view (schematic sectional view) of an image forming apparatus employing an electrophotographic system according to an embodiment of the present invention. A video controller 120 receives and processes image information and print instructions that are transmitted from an external device such as a host computer. A control portion 113, which serves as control means (energization controlling portion), is connected to the video controller 120, and controls parts constructing the image forming apparatus in response to instructions from the video controller 120. When the video controller 120 receives a print instruction from the external device, image formation is executed through the following operation.

An image forming apparatus 100 feeds a recording material P by a feed roller 102, thereby conveying the recording material P toward an intermediate transfer belt 103. A process cartridge 101 integrally includes a photosensitive drum 104, a developing device 107, and a primary charging device 105, which are described later, and is removably mounted to an image forming apparatus main body by a user. The photosensitive drum 104 is driven to rotate with the power of a drive motor, which is not shown, at predetermined speed in the counterclockwise direction, and is uniformly charged by the primary charging device 105 during the rotation. A laser beam scanner 106 outputs laser light modulated depending on an image signal to selectively perform scanning exposure on the photosensitive drum 104, thereby forming an electrostatic latent image. The developing device 107 causes toner powder, which is a developing substance, to adhere to the electrostatic latent image to form a toner image (developing substance image) that is a visible image. The toner image formed on the photosensitive drum 104 is primarily transferred onto the intermediate transfer belt 103 that rotates in contact with the photosensitive drum 104.

Here, the photosensitive drum 104, the primary charging device 105, the laser beam scanner 106, and the developing device 107 respectively include photosensitive drums, primary charging devices, laser beam scanners, and developing devices that correspond to the four colors of cyan (C), magenta (M), yellow (Y), and black (K). That is, the above-mentioned process cartridge includes four process cartridges that correspond to toner colors different from each other and are arranged in the rotation direction of the intermediate transfer belt 103. Toner images of the four colors are sequentially transferred onto the intermediate transfer belt 103 through the same procedure in a superimposed manner. The toner image transferred onto the intermediate transfer belt 103 is, in a secondary transfer portion formed by the intermediate transfer belt 103 and a transfer roller 108, secondarily transferred onto a recording material P with transfer bias applied to the transfer roller 108. Toner that has not been secondarily transferred onto the recording material P and remained on the intermediate transfer belt 103 is collected by a cleaning blade 118. After that, a fixing apparatus (image heating apparatus) 200, which serves as an image heating portion, heats and pressurizes the recording material P using heat of the heater to fix the toner image. Consequently, the resultant is discharged out of the apparatus as an object having the image formed thereon.

The control portion 113 manages the conveyance status of the recording material P with a conveyance sensor 114, a registration sensor 115, a pre-fixing sensor 116, and an image-fixed sheet discharge sensor 117 that are provided on the conveyance path for the recording material P. In addition, the control portion 113 includes a storage portion configured to store a temperature control program and a temperature control table for the fixing apparatus 200. Heater driving means 400, which serves as heat generating element driving means, is connected to a commercial alternating current power supply 401, and supplies electric power to the fixing apparatus 200.

2. Configuration of Fixing Apparatus (Image Heating Apparatus)

Figure 3:
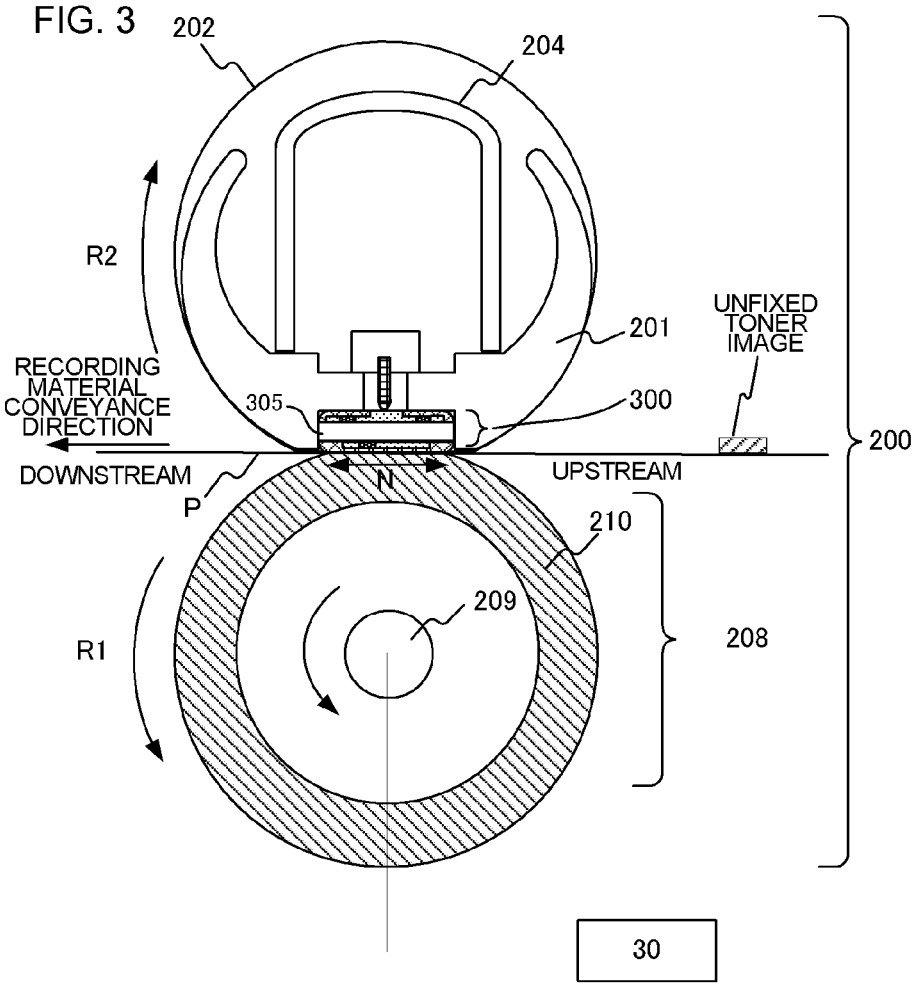
FIG. 3 is a schematic sectional view of a fixing apparatus 200 according to Embodiment 1.

FIG. 3 is a schematic sectional view of the fixing apparatus 200 in the present embodiment. The fixing apparatus 200 includes a fixing film 202, which serves as an endless belt, a heater 300 in contact with the inner surface of the fixing film 202, a pressure roller 208 forming a fixing nip portion N together with the heater 300 through the fixing film 202, and a metal stay 204. The fixing film 202 is a multilayered heat-resistant film formed into a tubular shape. The pressure roller 208 includes a core metal 209 made of, for example, iron or aluminum and an elastic layer 210 made of silicone rubber, for example. The heater 300 is a heater that is heated by a heat generating element provided on a substrate 305 made of ceramic, and heats the fixing film 202. The metal stay 204 receives pressurizing force, which is not shown, to bias a heater holding member 201 holding the heater 300 toward the pressure roller 208, to thereby form the fixing nip portion N between the fixing film 202 and the pressure roller 208. The pressure roller 208 receives power from a motor 30 to rotate in the direction of the arrow R1. When the pressure roller 208 rotates, the fixing film 202 follows the rotation to rotate in the direction of the arrow R2. The recording material P receives the heat from the fixing film 202 while being nipped and conveyed at the fixing nip portion N so that an unfixed toner image on the recording material P is subjected to fixing treatment.

3. Configuration of Heater

Figure 4A:
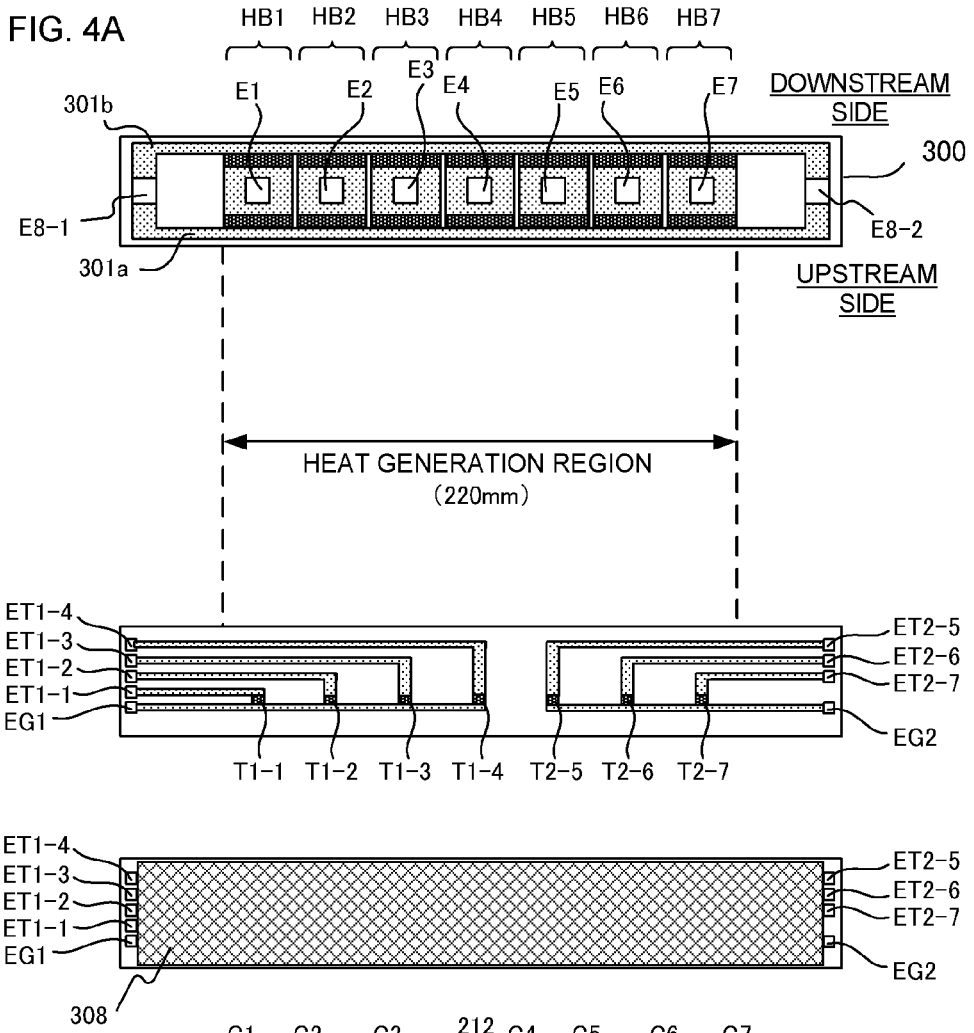
FIG. 4A and FIG. 4B are schematic configuration views of a heater 300 according to Embodiment 1.

FIG. 4A is a plan view illustrating the heater 300. The heater 300 of the present embodiment has, on the substrate, a total of seven heat generating blocks HB1 to HB7 (heating regions) including a plurality of heat generating elements that are obtained through division in the longitudinal direction of the heater 300. A region from the left end of the heat generating block HB1 in FIG. 4A to the right end of the heat generating block HB7 in FIG. 4A is a heat generation region having a length of 220 mm. In the present example, the heat generating blocks have the same longitudinal width (all the heat generating blocks do not necessarily have the same longitudinal width). Electrodes E1 to E7 are electrodes configured to supply electric power to the respective heat generating blocks HB1 to HB7. Electrodes E1 to E7, E8-1, and E8-2 are used for connection with electrical contacts C1 to C7, C8-1, and C8-2 used for supplying electric power from the heater driving means 400 of the heater 300 described later. The electrodes E8-1 and E8-2 are electrodes used for connection with a common electrical contact used for suppling electric power to the seven heat generating blocks HB1 to HB7 through a conductor 301*a* and a conductor 301*b*.

Through energization through the conductors 301*a* and 301*b* and conductors 303-1 to 303-7, first heat generating elements (heat generating resistors) 302*a*-1 to 302*a*-7 on the upstream side, and second heat generating elements 302*b*-1 to 302*b*-7 on the downstream side each generate heat. Though selection of the heat generating elements to be energized, the seven heating regions, which are obtained through division in the longitudinal direction, are selectively allowed to generate heat. Different combinations of the heating regions allowed to generate heat form various heat generation ranges based on the size of recording materials.

In the present embodiment, the electrodes E8-1 and E8-2 are provided at the ends in the longitudinal direction, but, for example, only the electrode E8-1 may be provided on one side or different electrodes may be provided in the upstream and downstream of the recording material conveyance direction. Further, electric power to be supplied to at least one heat generating block of the heat generating blocks, and electric power to be supplied to the remaining heat generating blocks can be independently controlled.

On a sliding surface (a surface in contact with the fixing film 202) of the heater 300, thermistors T1-1 to T1-4 and T2-5 to T2-7, which serve as temperature detecting elements, are provided to detect temperatures of the heat generating blocks HB1 to HB7 of the heater 300. The thermistors T1-1 to T1-4 and T2-5 to T2-7 in the present embodiment are each formed by thinly forming, on the substrate, a material having a positive temperature coefficient or a negative temperature coefficient (a material having the negative temperature coefficient in the present embodiment). The heat generating blocks HB1 to HB7 all include the thermistors, and hence temperatures of all the heat generating blocks can be detected by detecting the resistance values of the thermistors.

In order to energize the thermistors T1-1 to T1-4, the conductors ET1-1 to ET1-4 for thermistor resistance value detection and a common conductor EG1 for the thermistors are formed. Further, in order to energize the thermistors T2-5 to T2-7, conductors ET2-5 to ET2-7 for thermistor resistance value detection and a common conductor EG2 for the thermistors are formed. The thermistors T1-1 to T1-4 and the conductors ET1-1 to ET1-4 are covered with a surface protective layer 308 (glass in the present embodiment) having slidability. The surface protective layer 308 is at least provided in a region that slides on the fixing film 202, except for the end portions of the heater 300 so that the electrical contacts are provided to the conductors ET1-1 to ET1-4 and ET2-5 to ET2-7 and the common conductors EG1 and EG2.

Figure 4B:
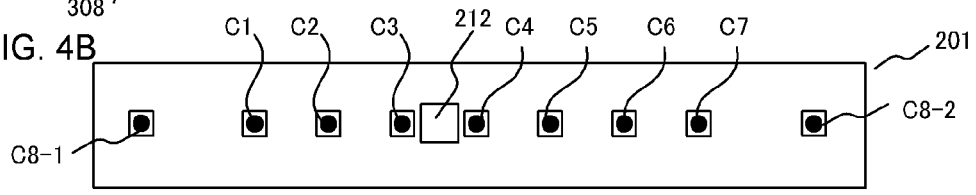

As illustrated in FIG. 4B, the holding member 201 of the heater 300 has formed therein a hole through which a spring is mounted to connect the electrodes E1, E2, E3, E4, E5, E6, E7, E8-1, and E8-2 to the electrical contacts C1 to C7, C8-1, and C8-2. Each electrical contact is connected to the control portion 113 through a cable or a conductive material such as a thin metal plate provided in a space between the metal stay 204 and the holding member 201. Further, the electrical contacts provided to the conductors ET1-1 to ET1-4 and ET2-5 to ET2-7 for thermistor resistance value detection, and the common conductors EG1 and EG2 for the thermistors are also connected to the heater driving means 400, which is described later.

4. Configuration of Heater Controlling Circuit

Figure 5:
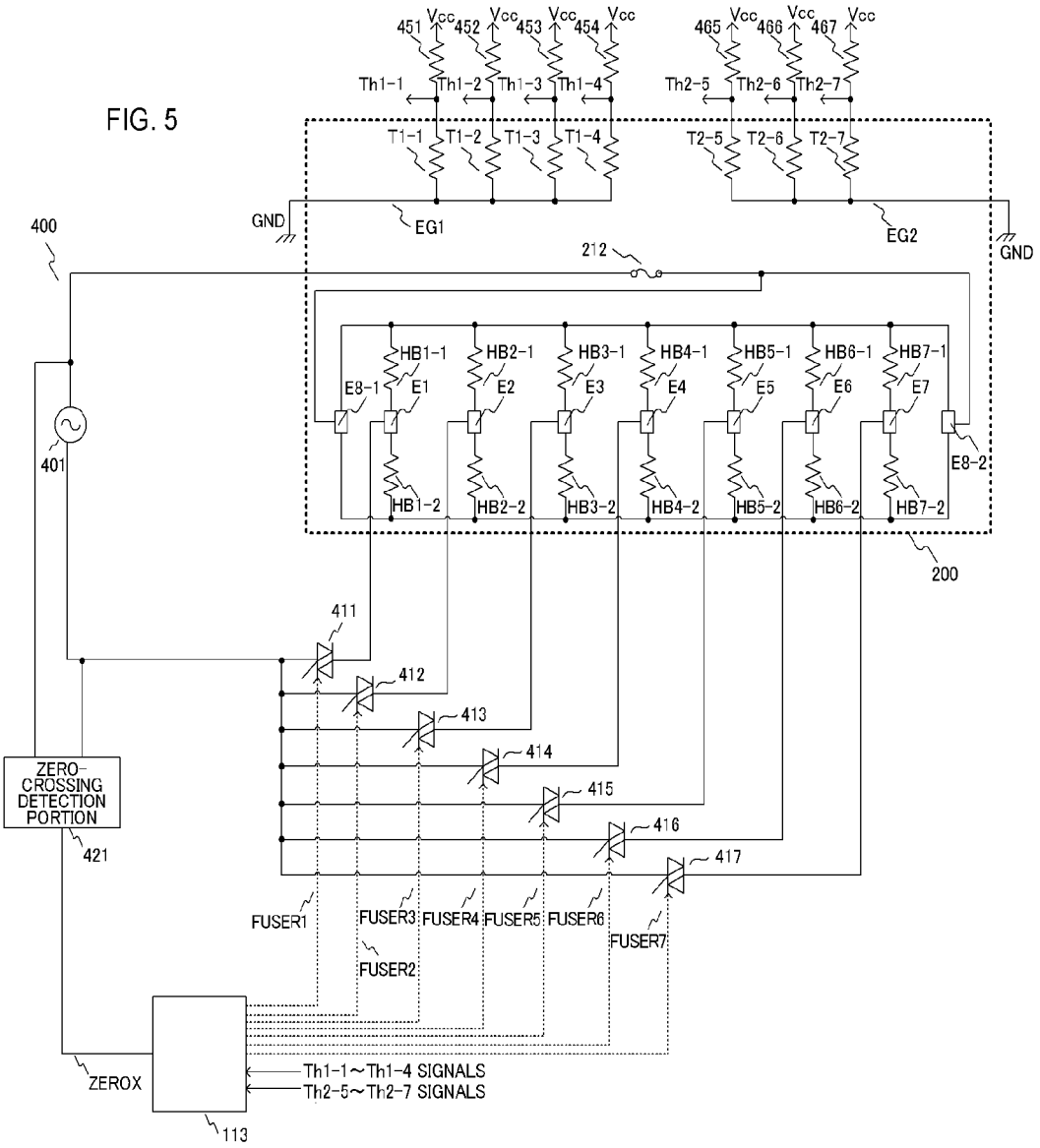
FIG. 5 is a schematic view of heater driving means 400 according to Embodiment 1.

FIG. 5 is a circuit diagram illustrating the heater driving means 400 of the heater 300 according to Embodiment 1. The commercial alternating current power supply 401 is connected to the image forming apparatus 100. Electric power control of the heater 300 is performed by energizing a triac 411 to a triac 417 or cutting off the energization. The triacs 411 to 417 operate on the basis of respective signals FUSER1 to FUSER7 from the control portion 113. A drive circuit for the triacs 411 to 417 is omitted in the illustration. The heater driving means 400 of the heater 300 has a circuit configuration that can independently control the seven heat generating blocks HB1 to HB7 with the seven triacs 411 to 417. A zero-crossing detection portion 421 is a circuit configured to detect the zero crossing of the alternating current power supply 401, and outputs a signal ZEROX to the control portion 113. The signal ZEROX is used for, for example, detecting the timing of phase control or wavenumber control of the triacs 411 to 417.

Next, a method for detecting the temperature of the heater 300 is described. With respect to temperatures that are detected by the thermistors T1-1 to T1-4, pressures divided by the thermistors T1-1 to T1-4 and resistors 451 to 454 are detected by the control portion 113 as signals Th1-1 to Th1-4. In a similar manner, with respect to temperatures that are detected by the thermistors T2-5 to T2-7, pressures divided by the thermistors T2-5 to T2-7 and resistors 465 to 467 are detected by the control portion 113 as signals Th2-5 to Th2-7. The processing inside the control portion 113 is as follows. Electric power to be supplied is calculated through PI control, for example, on the basis of a set temperature (control target temperature) of each heat generating block and a temperature detected by each thermistor. In addition, the resultant is converted to the control level of a phase angle (phase control) or a wavenumber (wavenumber control)

corresponding to the electric power to be supplied. The triacs 411 to 417 are controlled under this control conditions.

5. Heater Control Method Based on Image Information

In the image forming apparatus of the present embodiment, electric power supply to the seven heat generating blocks HB1 to HB7 of the heater 300 is controlled on the basis of image information from the external device (not shown), such as the host computer, and a heating mode used in printing of the recording material P.

Figure 6:
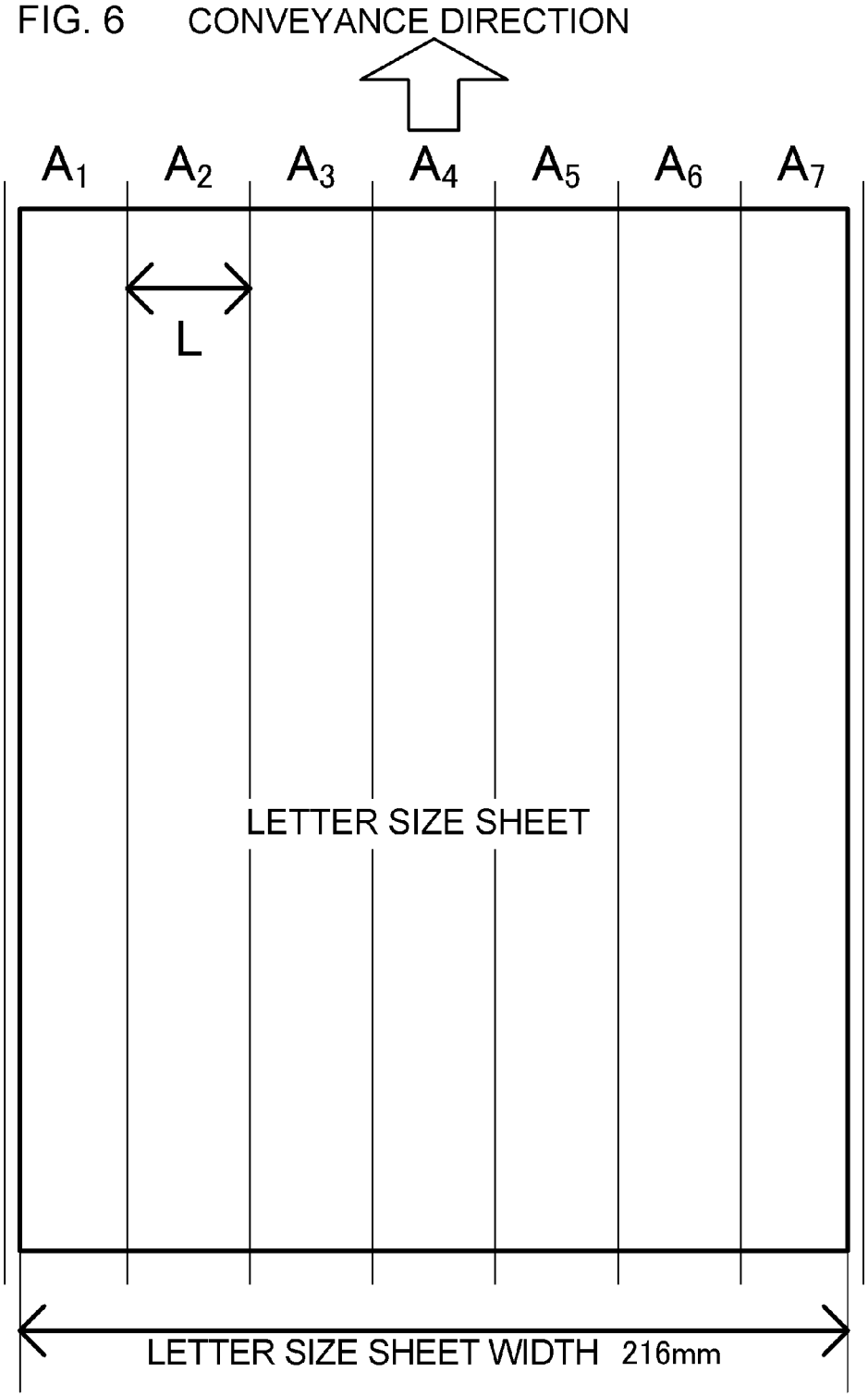
FIG. 6 is a diagram illustrating heating regions $A_1$ to $A_7$ according to Embodiment 1.

FIG. 6 is a diagram illustrating the seven heating regions $A_1$ to $A_7$, which are obtained through division in the longitudinal direction, in the present embodiment, in which the heating regions $A_1$ to $A_7$ are compared to a letter size sheet in size. The heating regions $A_1$ to $A_7$ correspond to the heat generating blocks HB1 to HB7. The heating region $A_1$ is heated by the heat generating block HB1, and the heating region $A_7$ is heated by the heat generating block HB7. In the present embodiment, the entire length of the heating regions $A_1$ to $A_7$ is 220 mm, and each heating region has a length obtained by equality dividing the entire length into seven (L=31.4 mm).

Figure 7:
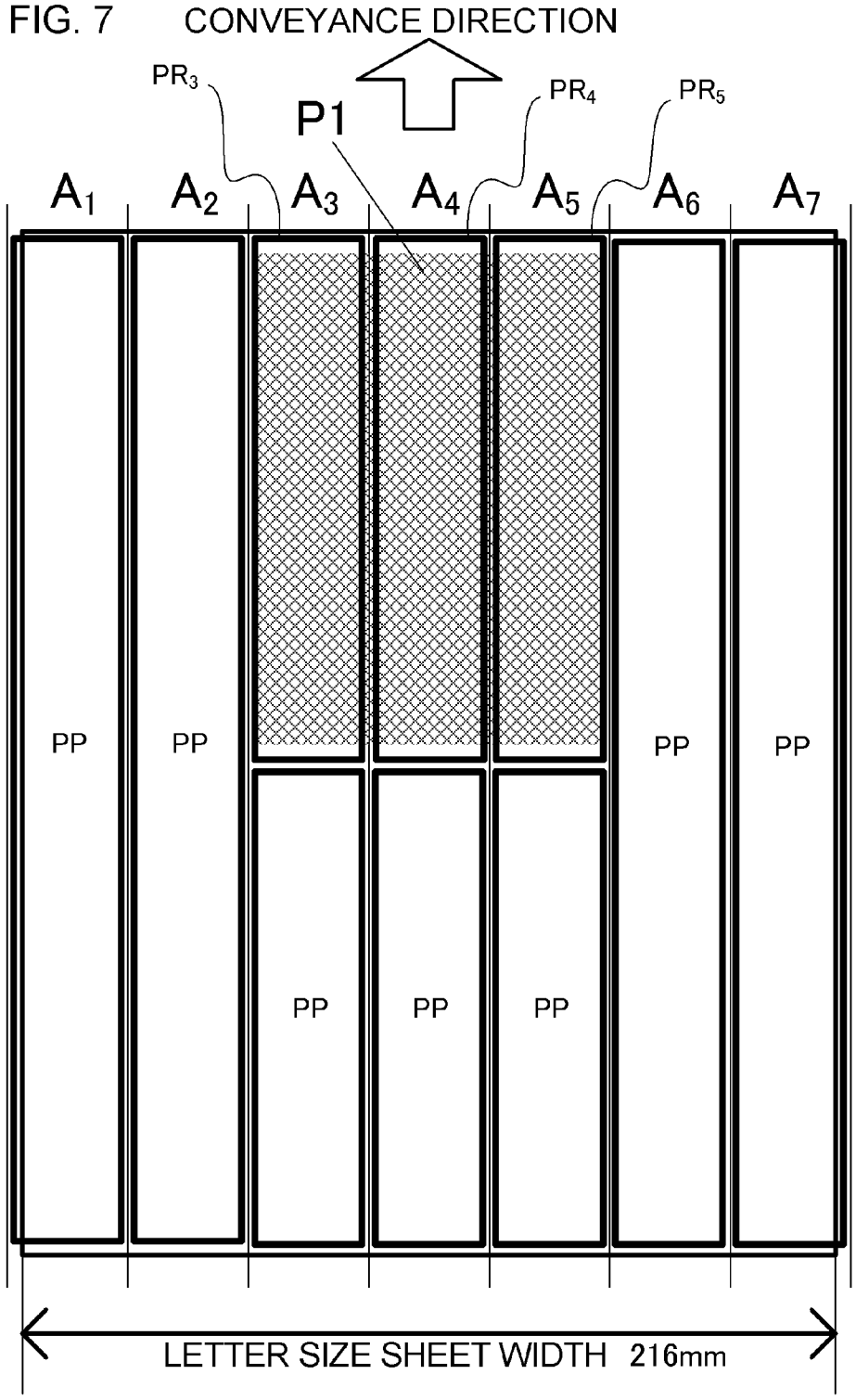
FIG. 7 is a diagram illustrating an image P1 and an image heating portion PR according to Embodiment 1.

FIG. 7 is a diagram illustrating an image P1 to be formed on the recording material P and an image heating portion PR corresponding to the image P1 in the present embodiment. The image heating portion PR (image heating region) is a section in each heating region in which a portion having an image formed therein is heated, and is represented by a bold frame overlapping with the image P1 (hatched portion) in FIG. 7. Further, a section other than the image heating portion PR in the heating region is a non-image heating portion PP (non-image heating region), and is represented by a bold frame. In the present embodiment, an image heating portion of an image to be formed in a heating region $A_i$ (i=1 to 7) is denoted by $PR_i$ (i=1 to 7) for description. The image P1 is formed in the heating regions $A_3$ to $A_5$, and the heating regions have the respective image heating portions $PR_3$ to $PR_5$. Portions other than the image heating portions $PR_3$ to $PR_5$ in the heating regions $A_3$ to $A_5$ correspond to the non-image heating portion PP. The image is not formed in the entire regions of the heating regions $A_1$, $A_2$, $A_6$, and $A_7$, and hence the entire regions of the heating regions $A_1$, $A_2$, $A_6$, and $A_7$ correspond to the non-image heating portion PP.

Figure 1:
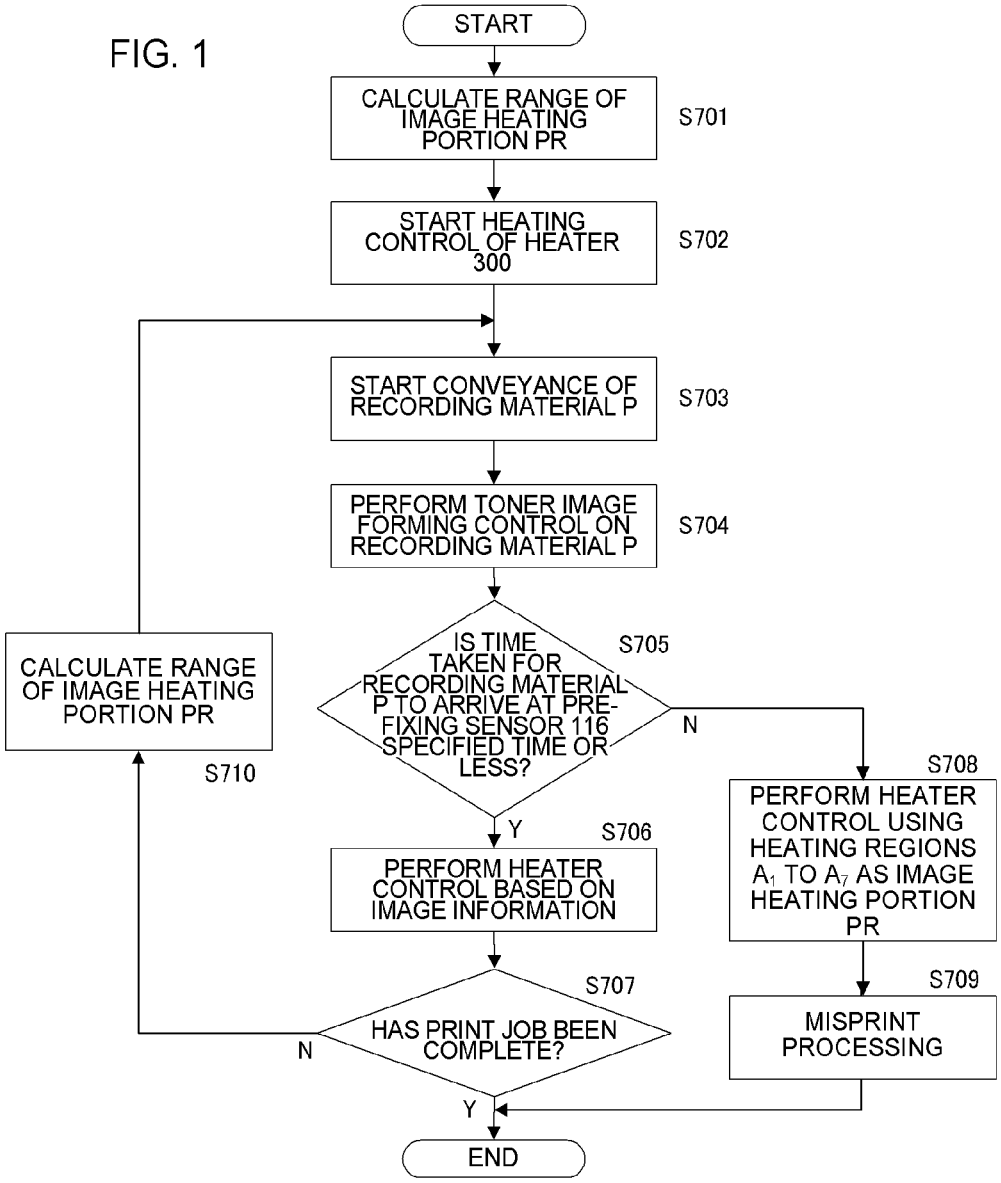
FIG. 1 is a flowchart illustrating heating control according to Embodiment 1.

Heater control in the present embodiment is described with reference to the flowchart of FIG. 1. First, when receiving image information from the host computer, the video controller 120 calculates the range of the image heating portion PR in Step S701. Next, in Step S702, the control portion 113 starts temperature control of each heat generating block so that an unfixed toner image is fixed to the recording material P when the image heating portion PR passes through the fixing nip portion N. After that, in Step S703, the control portion 113 feeds the recording material P by the feed roller 102 to start conveyance control toward the intermediate transfer belt 103. Subsequently, in Step S704, the control portion 113 performs toner image forming control up to secondarily transferring the toner image onto the recording material P.

In Step S705, the control portion 113, which serves as an abnormality detecting portion, detects, by the pre-fixing sensor 116 configured to detect whether or not a recording material is present on the conveyance path, the conveyance status of the recording material P that indicates whether the recording material P arrives at the pre-fixing sensor 116 within a specified time from the feed start in Step S703. When determining that the recording material P arrives in the specified time (no abnormality), the control portion 113 performs, in Step S706, heater control based on the range of the image heating portion PR calculated in Step S701. After that, the control portion 113 determines whether image forming processing has been complete for all pages in Step S707. When determining that the image forming processing has not been complete, the control portion 113 calculates the range of the image heating portion PR on a next page in Step S710, and then continuously executes the image forming processing from Step S703.

When the recording material P does not arrive at the pre-fixing sensor 116 in the specified time in Step S705, the control portion 113 determines that during conveyance of the recording material P, a conveyance failure such as a skew or a slip may occur, and a secondary transfer position on the recording material P may be deviated from a normal position (abnormality). In such a case, the control portion 113 performs, in Step S708, heating control using all the heating regions $A_1$ to $A_7$ of the heater 300 as the image heating portion PR to completely fix the toner image formed on the recording material P, and then discharges the resultant from the image forming apparatus. In addition, in Step S709, after discharging the recording material P out of the image forming apparatus 100, as misprint processing, the control portion 113 interrupts image formation, and executes stop processing of the image forming apparatus 100.

As in the description of the present embodiment above, when a time taken for the recording material P to arrive at the sensor placed on the conveyance path is deviated from a specified timing, the control portion 113 determines that there is an abnormality in the conveyance of the recording material P, and a secondary transfer position on the recording material P is thus deviated from a specified position. In such a case, the control portion 113 can control the temperate of the entire surface of the heater 300 to an image heating temperature to completely fix a toner image formed on the recording material P, and then discharge the resultant out of the image forming apparatus 100.

The present embodiment includes the control for controlling the control target temperature of the non-image heating portion PP for a case where an abnormality occurs to the same temperature as the control target temperature of the image heating portion PR. However, the control target temperatures are not necessarily set to the same temperature. Specifically, an increase in amount of electric power supply that is necessary for heating a non-image region when an abnormality occurs may be controlled to a value allowing toner adhering to the non-image region to be fixed.

Embodiment 2

In Embodiment 2, there is described an example in which, even when an abnormality occurs in the laser beam scanner 106, a toner image formed in a non-image region can be completely fixed, and then the resultant can be discharged out of the image forming apparatus 100. The remaining configuration is the same as that in Embodiment 1, and hence detailed description thereof is omitted.

6. Configuration of Laser Beam Scanner 106

Figure 8:
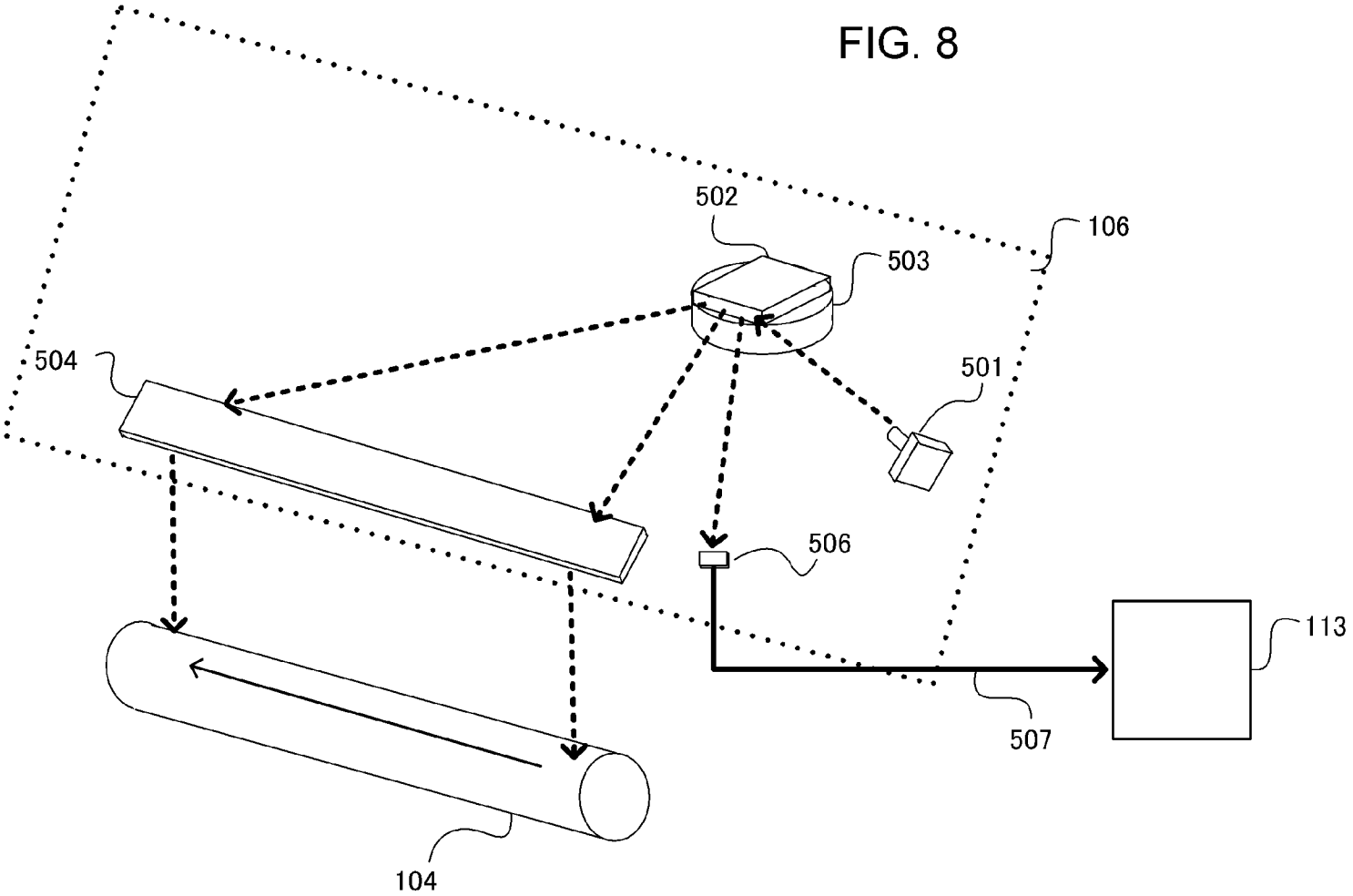
FIG. 8 is a diagram illustrating the configuration of a laser beam scanner.

FIG. 8 is a configuration view of the laser beam scanner 106, which serves as an optical device. A semiconductor laser 501 is a light source for exposing an image. A polygon mirror 502 is a multifaceted rotating reflector, and reflects laser light from the semiconductor laser 501 to irradiate the surface of the photosensitive drum 104 with the laser light through a reflection mirror 504. A scanner motor 503, which is an example of rotation driving means, rotates the polygon mirror. The scanner motor 503 rotates the polygon mirror 502 to scan the photosensitive drum 104 with laser light from the semiconductor laser 501. In the laser scanning optical path, a horizontal synchronization sensor 506, which is an example of reference detecting means, is provided. The horizontal synchronization sensor 506 generates a horizontal synchronization signal 507 at a timing at which laser light is radiated on the position of the horizontal synchronization sensor 506. The horizontal synchronization signal 507 is generated every laser light scanning, and an interval (period) of the horizontal synchronization signal 507 corresponds to time of one scanning (scanning period) of laser light. In the following, the horizontal synchronization signal 507 is referred to as "beam detect (BD) signal 507", and an interval of the BD signal 507 is referred to as "BD period". Further, the BD signal 507 is used as a scanning start reference signal in a main scanning direction, and is used as a writing start position in the main scanning direction. In addition, the control portion 113 has a speed control function of causing the scanner motor 503 to reach the target number of rotations on the basis of a current BD period.

Figure 9:
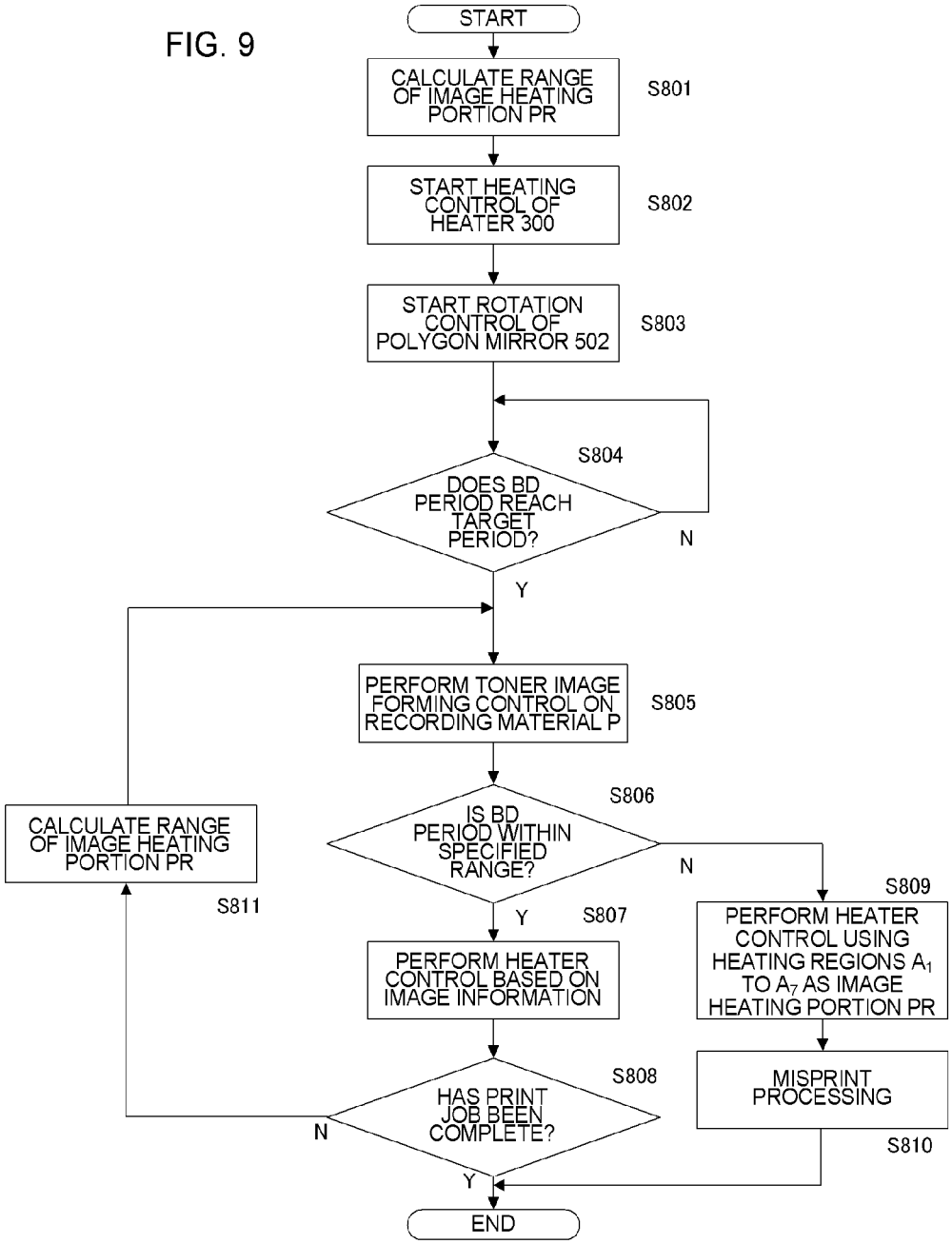
FIG. 9 is a flowchart illustrating heating control according to Embodiment 2.

Heater control in the present embodiment is described with reference to the flowchart of FIG. 9. First, when receiving image information from the host computer, the video controller 120 calculates the range of the image heating portion PR in Step S801. Next, in Step S802, the control portion 113 starts temperature control of each heat generating block so that an unfixed toner image is fixed to the recording material P when the image heating portion PR passes through the fixing nip portion N. After that, in Step S803, the control portion 113 starts speed control of the polygon mirror on the basis of the period of the BD signal 507, and waits until the BD period reaches a target period in Step S804. Subsequently, in Step S805, the control portion 113 performs toner image forming control up to secondarily transferring the toner image onto the recording material P.

In Step S806, the control portion 113 monitors whether the BD period is within a specified range with respect to the target period (the number of rotations of the rotating polygon mirror is within a specified range of rotation number) in a period in which an electrostatic latent image (electrostatic image) is formed on the photosensitive drum (photosensitive member) 104. When determining that the BD period is within the specified range in Step S806, the control portion 113 performs, in Step S807, heater control based on the range of the image heating portion PR calculated in Step S801. After that, the control portion 113 determines whether image forming processing has been complete for all pages in Step S808. When determining that the image forming processing has not been complete, the control portion 113 calculates the range of the image heating portion PR on a next page in Step S811, and then continuously executes the image forming processing from Step S805.

When detecting that the BD period is out of the specified range in Step S806, the control portion 113 determines that there may be an abnormality in the rotation control of the polygon mirror 502, and an electrostatic latent image forming position on the photosensitive drum 104 may be deviated from a normal position in the main scanning direction. In such a case, the control portion 113 performs, in Step S809, heating control using all the heating regions $A_1$ to $A_7$ of the heater 300 as the image heating portion PR to completely fix the toner image formed on the recording material P, and then discharges the resultant from the image forming apparatus. In addition, in Step S810, after discharging the recording material P out of the image forming apparatus 100, as misprint processing, the control portion 113 interrupts image formation, and executes stop processing of the image forming apparatus 100.

As in the description of the present embodiment above, when a BD period is deviated from a specified timing, the control portion 113 determines that there is an abnormality in the rotation control of the polygon mirror, and an image forming position on the recording material P is deviated from a specified position. In such a case, the control portion 113 can control the temperate of the entire surface of the heater 300 to an image heating temperature to completely fix a toner image formed on the recording material P, and then discharge the resultant out of the image forming apparatus 100.

Embodiment 3

In Embodiment 3, there is described an example in which, even when an abnormality occurs in a charge generating circuit (not shown) connected to the primary charging device 105, a toner image formed in a non-image region can be completely fixed, and then the resultant can be discharged out of the image forming apparatus 100. The remaining configuration is the same as that in Embodiment 1, and hence detailed description thereof is omitted.

7. Configuration of Charge Generating Circuit

Figure 10:
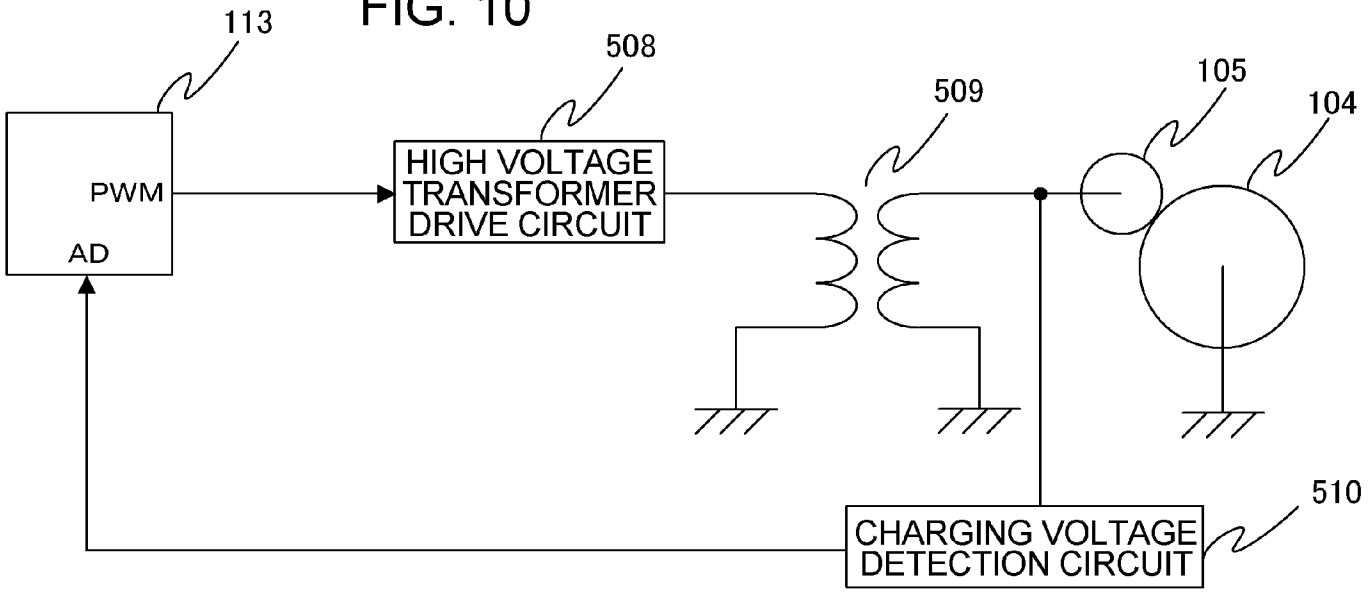
FIG. 10 is a diagram illustrating the configuration of a charge generating circuit.

FIG. 10 is a configuration view of the charge generating circuit. A high voltage transformer drive circuit 508 controls electric power supply to a high voltage transformer 509 on the basis of a PWM signal from the control portion 113. The high voltage transformer 509 is a voltage converter, and generates a high voltage of −600 V. With the generated high voltage, the photosensitive drum 104 is primarily charged through the primary charging device 105. A charging voltage detecting circuit 510 detects the generated charging voltage, and converts charging voltage output to a voltage of from 0 to 3.3 V. The output of the charging voltage detecting circuit 510, which serves as a voltage detecting portion, is converted to a digital value by an AD conversion portion in the control portion 113. Further, the control portion 113 has a constant voltage control function of causing the charging voltage to reach a target voltage on the basis of the AD converted value.

Figure 11:
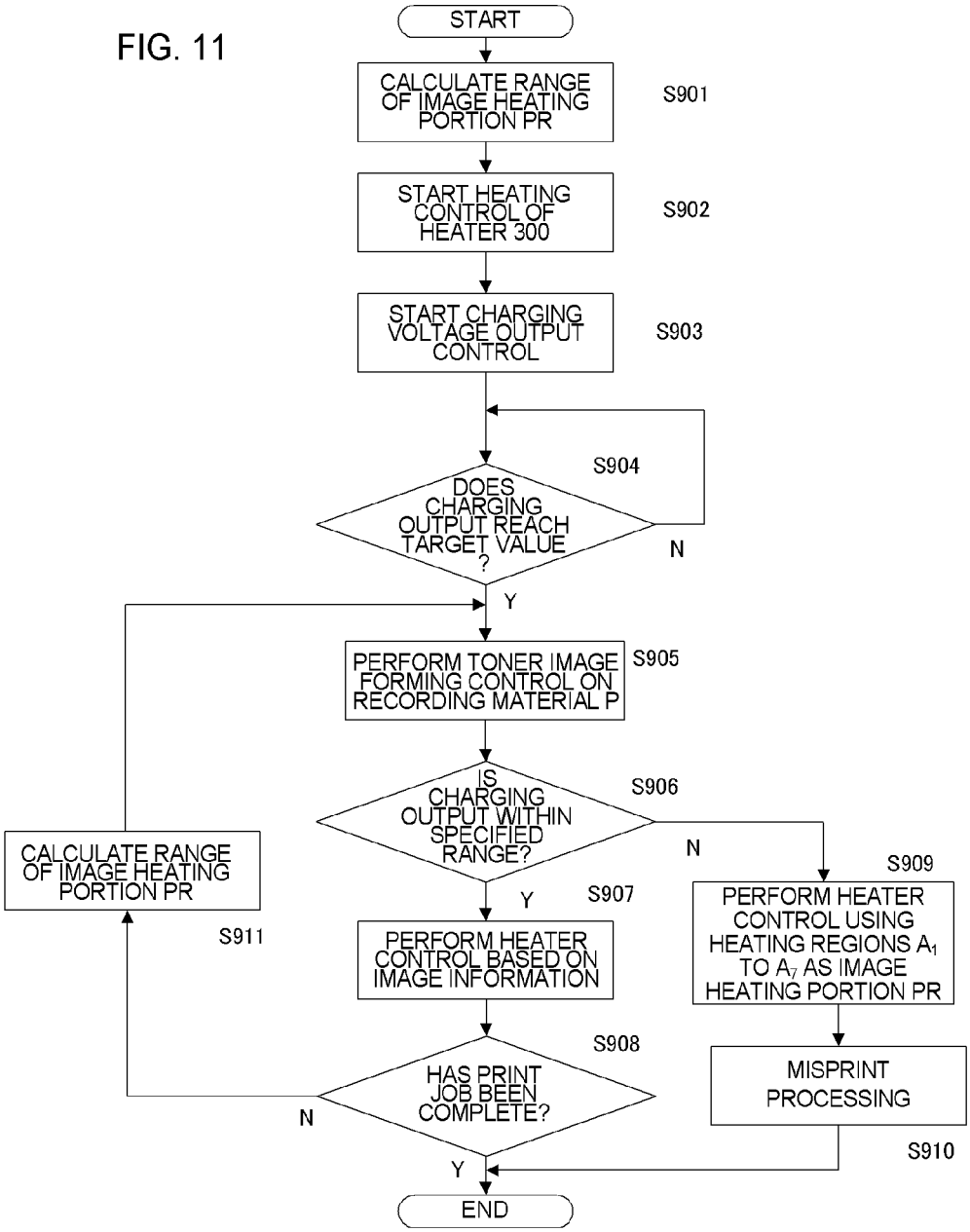
FIG. 11 is a flowchart illustrating heating control according to Embodiment 3.

Heater control in the present embodiment is described with reference to the flowchart of FIG. 11. First, when receiving image information from the host computer, the video controller 120 calculates the range of the image heating portion PR in Step S901. Next, in Step S902, the control portion 113 starts temperature control of each heat generating block so that an unfixed toner image is fixed to the recording material P when the image heating portion PR passes through the fixing nip portion N. After that, in Step S903, the control portion 113 starts charging voltage output control on the basis of an AD converted value, and waits until charging output reaches a target value in Step S904. Subsequently, in Step S905, the control portion 113 performs toner image forming control up to secondarily transferring the toner image onto the recording material P.

In Step S906, the control portion 113 monitors whether the charging voltage is within a specified output range with respect to the target voltage in a period in which an electrostatic latent image is formed on the photosensitive drum 104. When determining that the charging voltage is within the specified range in Step S906, the control portion 113 performs, in Step S907, heater control based on the range of the image heating portion PR calculated in Step S901. After that, the control portion 113 determines whether image forming processing has been complete for all pages in Step S908. When determining that the image forming processing has not been complete, the control portion 113 calculates the range of the image heating portion PR on a next page in Step S911, and then continuously executes the image forming processing from Step S905.

When detecting that the charging voltage is out of the specified output range in Step S906, the control portion 113 determines that there may be an abnormality in the charge generating circuit, and a toner image unrelated to the image signal may be formed in a non-image region. In such a case, the control portion 113 performs, in Step S909, heating control using all the heating regions $A_1$ to $A_7$ of the heater 300 as the image heating portion PR to completely fix the toner image formed on the recording material P, and then discharges the resultant from the image forming apparatus. In addition, in Step S910, after discharging the recording material P out of the image forming apparatus 100, as misprint processing, the control portion 113 interrupts image formation, and executes stop processing of the image forming apparatus 100.

As in the description of the present embodiment above, when a charging voltage is out of a specified range, the control portion 113 determines that there may be an abnormality in the charge generating circuit, and a toner image may also be formed in a non-image region. In such a case, the control portion 113 can control the temperate of the entire surface of the heater 300 to an image heating temperature to completely fix the toner image formed on the recording material P, and then discharge the resultant out of the image forming apparatus 100.

Embodiment 4

In Embodiment 4, there is proposed an embodiment that can deal with a case where the end of life of the cleaning blade 118, which cleans toner that has not been secondarily transferred and remained on the intermediate transfer belt 103, is reached, and the cleaning performance of the intermediate transfer belt 103 is thus deteriorated. Also in the present embodiment, a toner image formed in a non-image region can be completely fixed, and then the resultant can be discharged out of the image forming apparatus 100. The remaining configuration is the same as that in Embodiment 1, and hence detailed description thereof is omitted.

The intermediate transfer belt 103 and the cleaning blade 118 are integrally constructed. Thus, in the present embodiment, the control portion 113 determines the life (consumption degree) of the cleaning blade 118, which serves as a consumable cleaning member, with the use of usage time of the intermediate transfer belt 103, which serves as a transfer member. The control portion 113, which serves as a consumption detecting portion, increases a counter in the control portion 113 per predetermined period of time during rotation of the intermediate transfer belt 103, to thereby detect the usage time of the intermediate transfer belt 103. Further, the intermediate transfer belt 103, which is a consumable item, can be replaced by a new one by the user. When detecting that the intermediate transfer belt 103 is replaced by a new one by the user, the control portion 113 clears the above-mentioned counter to zero. A method for determining that the intermediate transfer belt 103 is replaced by a new one by the user includes reading, by the control portion 113, a memory chip (not shown) mounted on the intermediate transfer belt 103.

Figure 12:
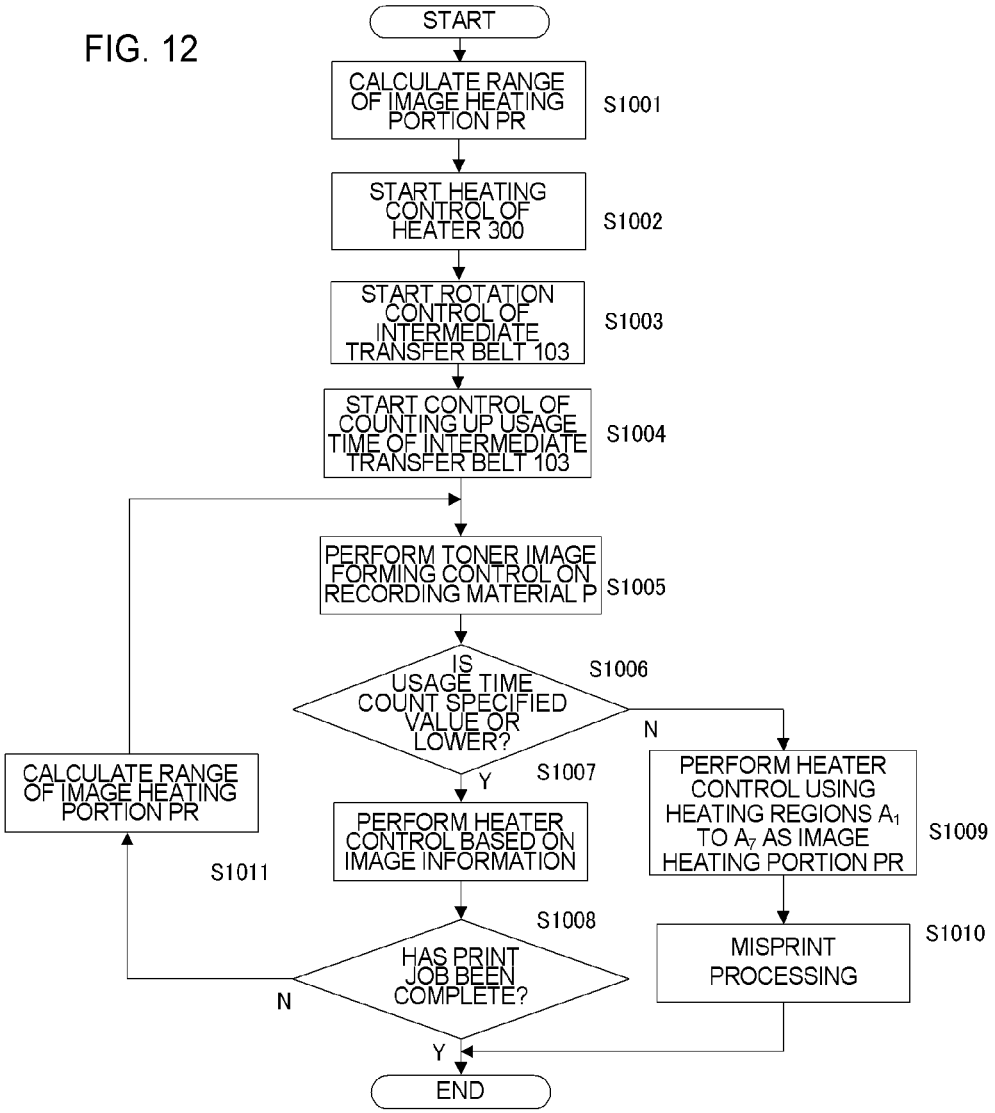
FIG. 12 is a flowchart illustrating heating control according to Embodiment 4.

Heater control in the present embodiment is described with reference to the flowchart of FIG. 12. First, when receiving image information from the host computer, the video controller 120 calculates the range of the image heating portion PR in Step S1001. Next, in Step S1002, the control portion 113 starts temperature control of each heat generating block so that an unfixed toner image is fixed to the recording material P when the image heating portion PR passes through the fixing nip portion N. Then, in Step S1003, the control portion 113 starts rotation control of the intermediate transfer belt 103, and increases the counter in the control portion 113 per predetermined period of time to detect usage time of the intermediate transfer belt 103 in Step S1004. Subsequently, in Step S1005, the control portion 113 performs toner image forming control up to secondarily transferring the toner image onto the recording material P.

In Step S1006, the control portion 113 determines whether the usage time count described above is a specified value or lower. When determining that the usage time count is the specified value or lower (does not exceed a predetermined consumption degree) in Step S1006, the control portion 113 performs, in Step S1007, heater control based on the range of the image heating portion PR calculated in Step S1001. After that, the control portion 113 determines whether image forming processing has been complete for all pages in Step S1008. When determining that the image forming processing has not been complete, the control portion 113 calculates the range of the image heating portion PR on a next page in Step S1011, and then continuously executes the image forming processing from Step S1005.

When detecting that the usage time count is larger than the specified value (exceeds the predetermined consumption degree) in Step S1006, the control portion 113 determines that an image may be formed in a non-image region with toner having remained on the intermediate transfer belt 103 after secondary transfer, due to the deterioration of the cleaning blade 118. In such a case, the control portion 113 performs, in Step S1009, heating control using all the heating regions $A_1$ to $A_7$ of the heater 300 as the image heating portion PR to completely fix the toner image formed on the recording material P, and then discharges the resultant from the image forming apparatus. In addition, in Step S1010, after discharging the recording material P out of the image forming apparatus 100, as misprint processing, the control portion 113 interrupts image formation, and executes stop processing of the image forming apparatus 100.

As in the description of the present embodiment above, when the end of life of the intermediate transfer belt 103 is reached, the control portion 113 determines that a toner image may also be formed in a non-image region due to the deterioration of the cleaning blade 118. In such a case, the control portion 113 can control the temperate of the entire surface of the heater 300 to an image heating temperature to completely fix the toner image formed on the recording material P, and then discharge the resultant out of the image forming apparatus 100.

Embodiment 5

In Embodiment 5, there is proposed an embodiment that can deal with a case where a horizontal streak image unrelated to image information is generated in a non-image region due to the deterioration of the photosensitive drum 104, which serves as an image bearing member, in the process cartridge 101. Also in the present embodiment, a toner image formed in the non-image region can be completely fixed, and then the resultant can be discharged out of the image forming apparatus 100. The remaining configuration is the same as that in Embodiment 1, and hence detailed description thereof is omitted.

In the present embodiment, the control portion 113 detects the life of the process cartridge 101 (photosensitive drum 104) from the number of printed sheets. Specifically, the control portion 113 detects the life by increasing the counter in the control portion 113 every time one sheet is printed. Further, the process cartridge 101 can be replaced by a new one by the user. When detecting that the process cartridge 101 is replaced by a new one by the user, the control portion 113 clears the above-mentioned counter to zero. A method for determining that the process cartridge 101 is replaced by a new one by the user includes reading, by the control portion 113, a memory chip (not shown) mounted on the process cartridge 101.

Figure 13:
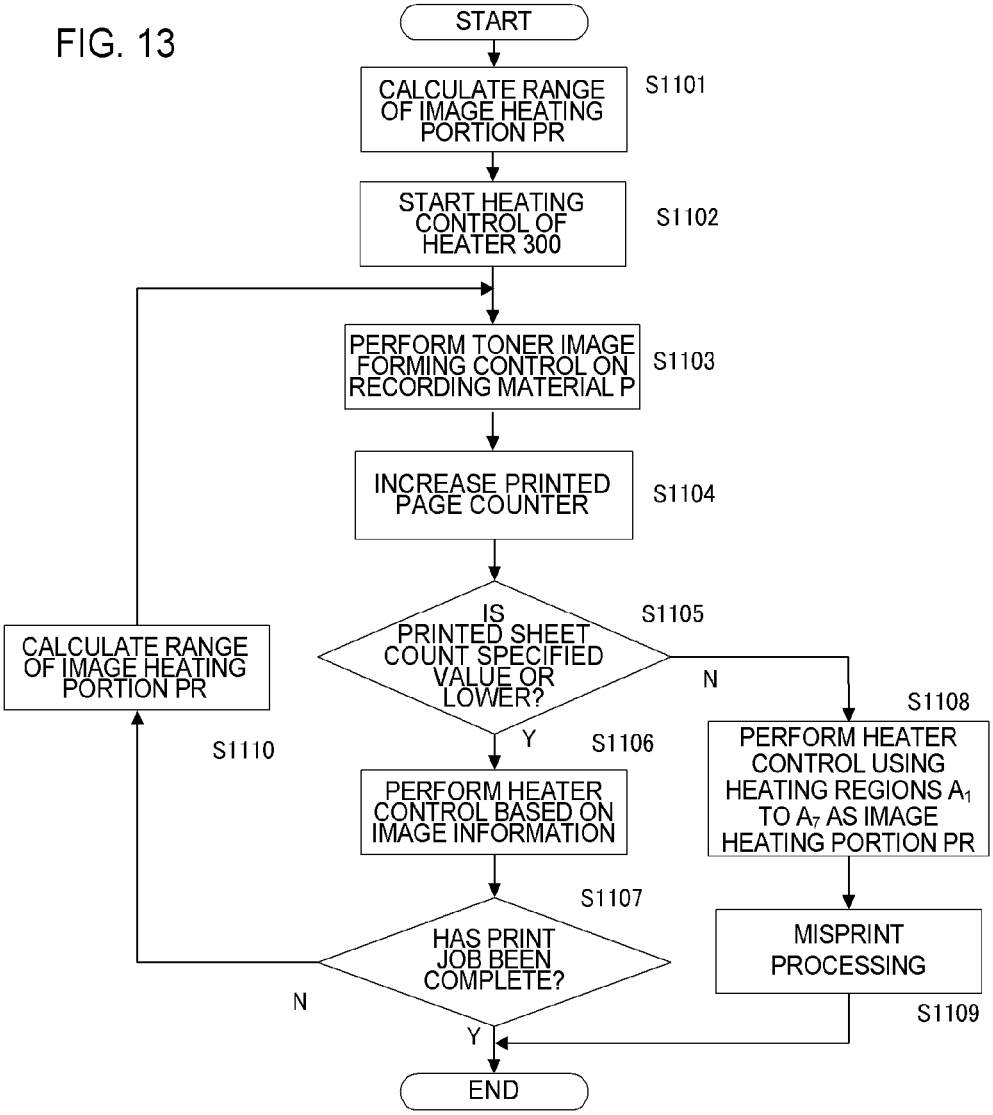
FIG. 13 is a flowchart illustrating heating control according to Embodiment 5.

Heater control in the present embodiment is described with reference to the flowchart of FIG. 13. First, when receiving image information from the host computer, the video controller 120 calculates the range of the image heating portion PR in Step S1101. Next, in Step S1102, the control portion 113 starts temperature control of each heat generating block so that an unfixed toner image is fixed to the recording material P when the image heating portion PR passes through the fixing nip portion N. Then, in Step S1103, the control portion 113 performs toner image forming control up to secondarily transferring the toner image onto the recording material P, and increases the counter every time a sheet is printed to add up the number of printed sheets in Step S1104.

In Step S1105, the control portion 113 determines whether the printed sheet count (the number of times the photosensitive drum 104 is used) described above is a specified value or lower. When determining that the printed sheet count is the specified value or lower in Step S1105, the control portion 113 performs, in Step S1106, heater control based on the range of the image heating portion PR calculated in Step S1101. After that, the control portion 113 determines whether image forming processing has been complete for all pages in Step S1107. When determining that the image forming processing has not been complete, the control portion 113 calculates the range of the image heating portion PR on a next page in Step S1110, and then continuously executes the image forming processing from Step S1103.

When detecting that the printed sheet count is larger than the specified value in Step S1105, the control portion 113 determines that a horizontal streak image unrelated to the image information may be formed in the main scanning direction due to the deterioration of the photosensitive drum 104. In such a case, the control portion 113 performs, in Step S1108, heating control using all the heating regions $A_1$ to $A_7$ of the heater 300 as the image heating portion PR to completely fix the toner image formed on the recording material P, and then discharges the resultant from the image forming apparatus. In addition, in Step S1109, after discharging the recording material P out of the image forming apparatus 100, as misprint processing, the control portion 113 interrupts image formation, and executes stop processing of the image forming apparatus 100.

As in the description of the present embodiment above, when the end of life of the process cartridge 101 is reached, the control portion 113 determines that a horizontal streak image unrelated to image information may be formed in a non-image region due to the deterioration of the photosensitive drum 104. In such a case, the control portion 113 can control the temperate of the entire surface of the heater 300 to an image heating temperature to completely fix a toner image formed on the recording material P, and then discharge the resultant out of the image forming apparatus 100.

The configurations of the above-mentioned embodiments can be combined with each other as far as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-000837, filed on Jan. 5, 2018, which is hereby incorporated by reference herein in its entirety.

What is claimed is:

1. An image forming apparatus for forming a toner image on a recording material, comprising:

a fixing portion configured to fix the toner image onto the recording material while the recording material is passing through a fixing nip portion, wherein the fixing portion includes a heater including a substrate, a first heat generating element provided on the substrate for heating a first region in the fixing nip portion, and a second heat generating element provided at a position different from the position on the substrate on which the first heat generating element is provided in a longitudinal direction of the substrate and for heating a second region in the fixing nip portion;

an energization controlling portion configured to control electric power supplied to each of the first and second heat generating elements so that a temperature of the first heat generating element is maintained at a first target temperature and a temperature of the second heat generating element is maintained at a second target temperature; and an abnormality detecting portion for detecting an abnormality in the image forming apparatus, wherein when a region of the recording material on which the toner image is formed passes through the first region and a region of the recording material on which the toner image is not formed passes through the second region, the energization controlling portion sets the first target temperature for the first heat generating element to a first temperature and sets the second target temperature for the second heat generating element to a second temperature lower than the first temperature, wherein when the abnormality detecting portion detects the abnormality, the energization controlling portion corrects the second target temperature to be a temperature higher than the second temperature, and wherein the abnormality detecting portion includes a sensor for detecting whether or not the recording material is present on a conveyance path, and detects the abnormality in accordance with the output of the sensor.

2. The image forming apparatus according to claim 1, wherein the fixing portion includes a tubular film and a roller contacting an outer surface of the film, wherein the heater is provided in an inner space of the film, and wherein the fixing nip portion is formed between the heater and the roller through the film.

3. An image forming apparatus for forming a toner image on a recording material, comprising:

a photosensitive member;

a charger configured to charge the photosensitive member;

an image scanner configured to scan the photosensitive member charged by the charger with a laser light in accordance with image information for forming an electrostatic image on the photosensitive member, a developing portion configured to develop the electrostatic image to the toner image using toner, a fixing portion configured to fix the toner image onto the recording material while the recording material is passing through a fixing nip portion, wherein the fixing portion includes a heater including a substrate, a first heat generating element provided on the substrate for heating a first region in the fixing nip portion, and a second heat generating element provided at a position different from the position on the substrate on which the first heat generating element is provided in a longitudinal direction of the substrate and for heating a second region in the fixing nip portion;

an energization controlling portion configured to control electric power supplied to each of the first and second heat generating elements so that a temperature of the first heat generating element is maintained at a first target temperature and a temperature of the second heat generating element is maintained at a second target temperature; and an abnormality detecting portion for detecting an abnormality in the image forming apparatus, wherein when a region of the recording material on which the toner image is formed passes through the first region and a region of the recording material on which the toner image is not formed passes through the second region, the energization controlling portion sets the first target temperature for the first heat generating element to a first temperature and sets the second target temperature for the second heat generating element to a second temperature lower than the first temperature, wherein when the abnormality detecting portion detects the abnormality, the energization controlling portion corrects the second target temperature to a temperature higher than the second temperature, and wherein the abnormality detecting portion includes a sensor for detecting a scanning period of the laser light by the image scanner, and detects the abnormality in accordance with the output of the sensor.

4. The image forming apparatus according to claim 3, wherein the fixing portion includes a tubular film and a roller contacting an outer surface of the film, wherein the heater is provided in an inner space of the film, and wherein the fixing nip portion is formed between the heater and the roller through the film.

5. An image forming apparatus for forming a toner image on a recording material, comprising:

a photosensitive member;

a charger configured to charge the photosensitive member;

an image scanner configured to scan the photosensitive member charged by the charger with a laser light in accordance with image information for forming an electrostatic image on the photosensitive member, a developing portion configured to develop the electrostatic image to the toner image using toner, a fixing portion configured to fix the toner image onto the recording material while the recording material is passing through a fixing nip portion, wherein the fixing portion includes a heater including a substrate, a first heat generating element provided on the substrate for heating a first region in the fixing nip portion, and a second heat generating element provided at a position different from the position on the substrate on which the first heat generating element is provided in a longitudinal direction of the substrate and for heating a second region in the fixing nip portion;

an energization controlling portion configured to control electric power supplied to each of the first and second heat generating elements so that a temperature of the first heat generating element is maintained at a first target temperature and a temperature of the second heat generating element is maintained at a second target temperature; and an abnormality detecting portion for detecting an abnormality in the image forming apparatus, wherein when a region of the recording material on which the toner image is formed passes through the first region and a region of the recording material on which the toner image is not formed passes through the second region, the energization controlling portion sets the first target temperature for the first heat generating element to a first temperature and sets the second target temperature for the second heat generating element to a second temperature lower than the first temperature, wherein when the abnormality detecting portion detects the abnormality, the energization controlling portion corrects the second target temperature to a temperature higher than the second temperature, and wherein the abnormality detecting portion includes a sensor for detecting a charging voltage that is applied to the photosensitive member by the charger, and detects the abnormality in accordance with the output of the sensor.

6. The image forming apparatus according to claim 5, wherein the fixing portion includes a tubular film and a roller contacting an outer surface of the film, wherein the heater is provided in an inner space of the film, and wherein the fixing nip portion is formed between the heater and the roller through the film.

7. An image forming apparatus for forming a toner image on a recording material, comprising:

a fixing portion configured to fix the toner image onto the recording material while the recording material is passing through a fixing nip portion, wherein the fixing portion includes a heater including a substrate, a first heat generating element provided on the substrate for heating a first region in the fixing nip portion, and a second heat generating element provided at a position different from the position on the substrate on which the first heat generating element is provided in a longitudinal direction of the substrate and for heating a second region in the fixing nip portion;

an energization controlling portion configured to control electric power supplied to each of the first and second heat generating elements so that a temperature of the first heat generating element is maintained at a first target temperature and a temperature of the second heat generating element is maintained at a second target temperature; and an abnormality detecting portion for detecting an abnormality in the image forming apparatus, wherein when a region of the recording material on which the toner image is formed passes through the first region and a region of the recording material on which the toner image is not formed passes through the second region, the energization controlling portion sets the first target temperature for the first heat generating element to a first temperature and sets the second target temperature for the second heat generating element to a second temperature lower than the first temperature, wherein when the abnormality detecting portion detects the abnormality, the energization controlling portion corrects the second target temperature to a temperature higher than the second temperature, and wherein the abnormality detecting portion includes a consumption detecting portion for detecting a consumption degree of a consumable item provided in the image forming apparatus, and detects the abnormality in accordance with the output of the consumption detecting portion.

8. The image forming apparatus according to claim 7, wherein the consumable item is a cleaning member for cleaning a transfer member for transferring an image formed on a photosensitive member onto the recording material, and wherein the consumption degree is usage time of the transfer member.

9. The image forming apparatus according to claim 7, wherein a cartridge including a photosensitive member for forming an image that is formed on the recording material is removably mounted to an apparatus main body of the image forming apparatus, wherein the consumable item is the photosensitive member, and wherein the consumption degree is the number of times of image formation using the photosensitive member.

10. The image forming apparatus according to claim 7, wherein the fixing portion includes a tubular film and a roller contacting an outer surface of the film, wherein the heater is provided in an inner space of the film, and wherein the fixing nip portion is formed between the heater and the roller through the film.

* * * * *